US008627968B2

(12) United States Patent
Baban

(10) Patent No.: US 8,627,968 B2
(45) Date of Patent: Jan. 14, 2014

(54) SCREW CAP FOR CONTAINERS FOR LIQUIDS

(75) Inventor: Alberto Baban, Noale (IT)

(73) Assignee: Tapi North America S.A. de cv, Mexico City, D.F. (MX)

( * ) Notice: Subject to any disclaimer, the term of this patent is extended or adjusted under 35 U.S.C. 154(b) by 472 days.

(21) Appl. No.: 12/761,738

(22) Filed: Apr. 16, 2010

(65) Prior Publication Data

US 2010/0264108 A1 Oct. 21, 2010

(30) Foreign Application Priority Data

Apr. 16, 2009 (IT) ..... PD2009A0094

(51) Int. Cl.
*B65D 55/02* (2006.01)
*B65D 41/04* (2006.01)

(52) U.S. Cl.
USPC ..... 215/220; 215/330; 215/329; 215/252; 215/217; 220/288; 220/256.1; 220/255; 220/254.1

(58) Field of Classification Search
USPC ..... 215/230, 200, 21, 252, 232, 28, 228, 215/17, 18, 14, 801, 257–258, 521, 246, 215/273, 289, 9, 156, 217–221, 329, 334, 215/44–45; 220/255, 214, 288
See application file for complete search history.

(56) References Cited

U.S. PATENT DOCUMENTS 2,201,791 A 5/1940 Samburg
2,847,139 A * 8/1958 Christiansson et al. ..... 215/220
3,073,468 A * 1/1963 Arneson ..... 215/230
3,638,819 A * 2/1972 Roy ..... 215/220
3,710,970 A * 1/1973 Elfline ..... 215/215
3,722,727 A * 3/1973 Gach ..... 215/220
3,795,337 A * 3/1974 Nozawa et al. ..... 215/219
3,926,326 A * 12/1975 Grau ..... 215/218
3,944,102 A 3/1976 Grau
3,972,436 A * 8/1976 Grau ..... 215/220
4,018,640 A 4/1977 Amberg
4,220,247 A * 9/1980 Kramer ..... 215/219
4,433,789 A * 2/1984 Gibilisco ..... 215/220
4,440,306 A * 4/1984 Van Buskirk et al. ..... 215/230

(Continued)

FOREIGN PATENT DOCUMENTS

EP 1413526 B1 * 3/2007
FR 2179029 A 11/1973

(Continued)

OTHER PUBLICATIONS

Search Report from Italian priority application PD2009A000094.

*Primary Examiner* — Mickey Yu
*Assistant Examiner* — Brijesh V. Patel
(74) *Attorney, Agent, or Firm* — Kristina Castellano; Castellano PLLC

(57) ABSTRACT

A screw cap (10) for containers for liquids, comprising a first capsule (11), which is internally provided with a thread (12) and is to be screwed onto a corresponding complementary thread (13) of a neck of a bottle (14), and a second capsule (15), which surrounds said first capsule (11) and is designed to rise axially away from the first capsule (11) upon first unscrewing, by means of spacing means that act at the first rotation of the second capsule (15) with respect to the first capsule (11), means being provided for the irreversible locking of said second capsule (15) in the raised configuration relative to said first capsule (11).

16 Claims, 3 Drawing Sheets

(56) References Cited

U.S. PATENT DOCUMENTS

| | | | | | |
|---|---|---|---|---|---|
| 4,527,701 | A | * | 7/1985 | Schaubeck | 215/220 |
| 4,588,465 | A | * | 5/1986 | Paciorek | 156/220 |
| 4,705,181 | A | * | 11/1987 | Burke et al. | 215/220 |
| 4,832,218 | A | * | 5/1989 | Gibilisco | 215/220 |
| 5,005,718 | A | * | 4/1991 | Buono | 215/220 |
| 5,197,616 | A | * | 3/1993 | Buono | 215/220 |
| 5,562,226 | A | * | 10/1996 | Valyi et al. | 220/255.1 |
| 5,762,215 | A | | 6/1998 | Ogden | |
| 5,853,093 | A | * | 12/1998 | Neiger | 215/237 |
| 6,854,612 | B2 | * | 2/2005 | Thomson | 215/21 |
| 2007/0090110 | A1 | * | 4/2007 | Skelton et al. | 220/254.9 |
| 2009/0255897 | A1 | * | 10/2009 | Buczkowski | 215/230 |

FOREIGN PATENT DOCUMENTS

| | | | |
|---|---|---|---|
| WO | 00/37329 | A | 6/2000 |
| WO | 03/104100 | | 12/2003 |
| WO | WO 2008121086 | A1 * | 10/2008 |

* cited by examiner

SCREW CAP FOR CONTAINERS FOR LIQUIDS

CLAIM FOR PRIORITY

This application claims priority to Italian application PD2009A000094 filed Apr. 16, 2009, the contents of which are incorporated herein by reference.

FIELD

The present invention relates to a screw cap for containers for liquids. In particular, the screw cap according to the invention is particularly suitable for applications for bottles, particularly, but not exclusively, for alcoholic and superalcoholic drinks.

BACKGROUND

The screw cap is one of the mainly used closing systems for bottles and for containers for liquids in general, particularly for products of wide consumption, both for economic reasons owing to its moderate cost thereof, and also for its technical features suitable for guaranteeing the optimal sealing of the liquid inside the bottle and also appreciated flexibility in terms of visual impact.

This kind of cap has also the advantage of a very easy manual opening, that does not require the use of special devices such as corkscrews, as well as easy reclosing for leakage-proof conservation of the liquid in case remained into the bottle.

The screw cap may be made wholly of plastic material, or metallic material, with a metallic capsule and an internal seal of plastic material.

The screw cap is generally constituted of a capsule, that is a cup shaped body, having a thread, or one or more thread portions, at the inner part of the substantially cylindrical tract thereof.

Along the edge of the capsule it is generally provided a security ring, of the strip kind, that is fixed to the edge by means of a plurality of bridge elements to be broken upon the first unscrewing of the cap from the neck of the bottle to which the cap is screwed.

Such a security ring is made integral with the internally threaded capsule. Such a ring, consistently with the technical bounds of the mould, is shaped so as to surround the neck of the bottle below the thread and an adjoining anti-extraction shoulder, suitable for avoiding the raising of the security ring.

The security ring is so shaped to be blocked under said anti-extraction shoulder at the first unscrewing, so that the user, by continuing with the unscrewing, causes the breakage of the bridge elements and the detachment of the security ring, the latter remaining to surround the neck of the bottle to show the opening of the bottle.

Such screw caps, despite being appreciated and used, have some disadvantages.

The plastic caps, usually made monolithically with the safety ring, due to limits of the moulds, have a security ring that, due to the necessity of extracting by pulling out the moulded cap from the mould, does not extend radially towards the inner above a certain limited length fixed by the necessity of extracting the piece from the mould without breaking it.

The limit for the development of the safety ring in the radial direction can cause at the unscrewing of the cap from the bottle, or any other container for liquids to which the cap is associated, the safety ring rather than blocking against the anti-extraction shoulder slide over the anti-extraction shoulder, without tearing from the capsule of the cap, thus failing the function as security element and as opening signal.

The metallic safety rings that are counter-shaped on the same metallic capsule that is in turn semifinished on the neck of the bottle by rolling are safer regarding this aspect guaranteeing the tearing of the ring form the capsule.

On the other hand such metallic screw caps even though being extensively decoratable, have the tearing line that is visible, this being not so much visually pleasant.

Furthermore if the safety ring does not perfectly detach, due to the malleability of the metallic sheet with which the cap is made, it is necessary to intervene by hand or by a tool to complete the detachment.

Furthermore the safety ring fallen to surround the neck of the bottle is usually considered as an aesthetically depriving element, and it is common to remove the safety ring to avoid the movement thereof during the pouring operations to be seen.

A further example of known cap is described in WO00/37329. The cap described in that document consists of two capsules is susceptible of reciprocal separation at the first opening. The opening indication (tamper) is made evident by means of a coloured strip that is made visible as a consequence of the separation of the two capsules. In such a cap the irreversibility of the indication is made by the fact that between the capsules are provided fins that deform by pressing when an attempt is made to reclose the cap on the container.

Since specific means for effectively blocking the capsule one on the other are not provided, the external capsule have an undesired gap both rotational and axial in relation to the internal capsule, the gap jeopardizing the anti-tamper efficacy and the functionality of such a cap.

SUMMARY

The aim of the present invention is to provide a screw cap for containers for liquid, allowing a remedy to the cited disadvantages of the known screw caps.

Within this aim, it is an object of the present invention to provide a screw cap that points out the occurred opening in a definite manner and without the risks of the known caps with safety ring.

Another object of the invention is to provide a screw cap that is easy to manage with the known cap-moving and bottling machines.

A still another object of the invention is to provide a screw cap having a visual impact not lower that that of the known screw caps.

Another object of the invention is to provide a screw cap that after the first opening does not cause annoying movements of a safety ring on the neck of the corresponding bottle.

A further object of the invention is to provide a screw cap having technical performances not lower than those of known caps.

Another object of the invention is to provide a screw cap is to provide a screw cap that is easy to manufacture and easy to be used, that can be produced with known techniques and with limited expenses.

This aim, these objects and further objects that will better appear in the following non-limiting embodiments, are achieved by a screw cap for containers for liquids, characterized in that it comprises a first capsule, which is internally provided with a thread to be screwed onto a corresponding complementary thread of a neck of a bottle, and a second capsule, which surrounds said first capsule and which is designed to rise axially away from the first capsule upon first unscrewing, by means of spacing means that act upon the first rotation of the second capsule with respect to the first one, means being provided for the irreversible locking of said second capsule in the raised configuration with respect to said first capsule.

BRIEF DESCRIPTION OF THE DRAWINGS

Further features and advantages of the invention will become clearer from the description of two preferred, but not exclusive embodiments of the screw cap according to the invention, explained with reference to the appended drawings which are provided by way of non-limiting example and in which.

DETAILED DESCRIPTION

Figure 1:
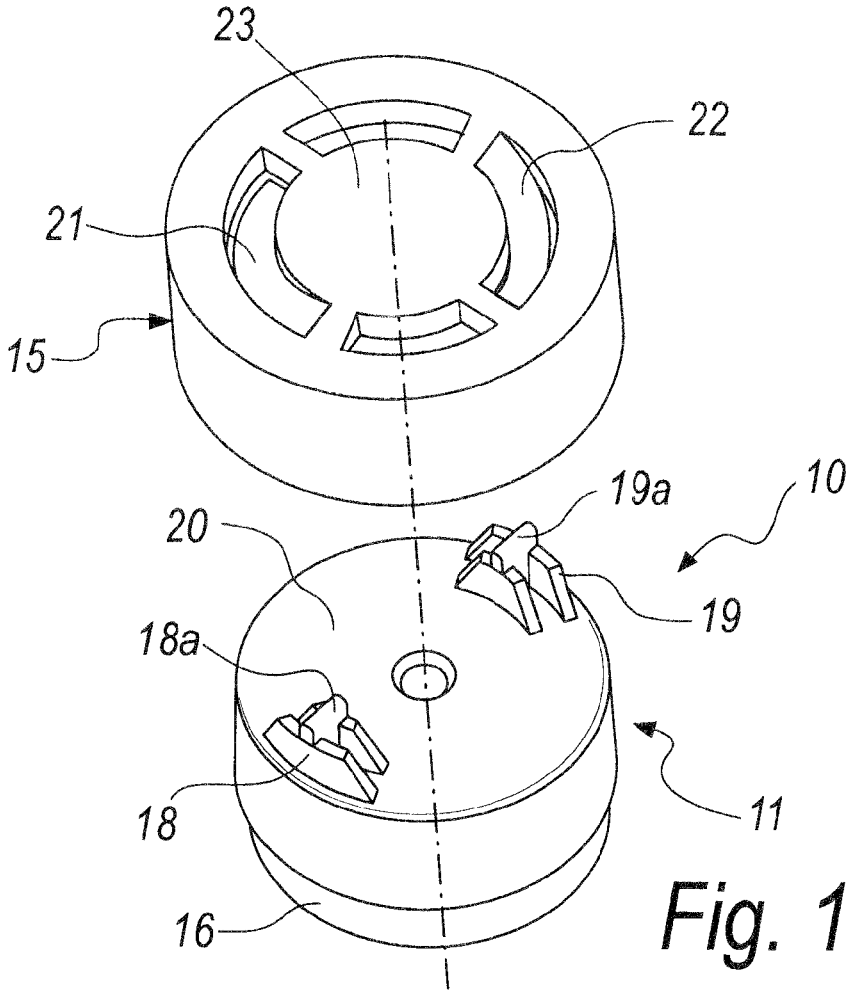
FIG. 1 is an exploded perspective view of a screw cap according to the invention, in a first variant thereof.
Figure 2:
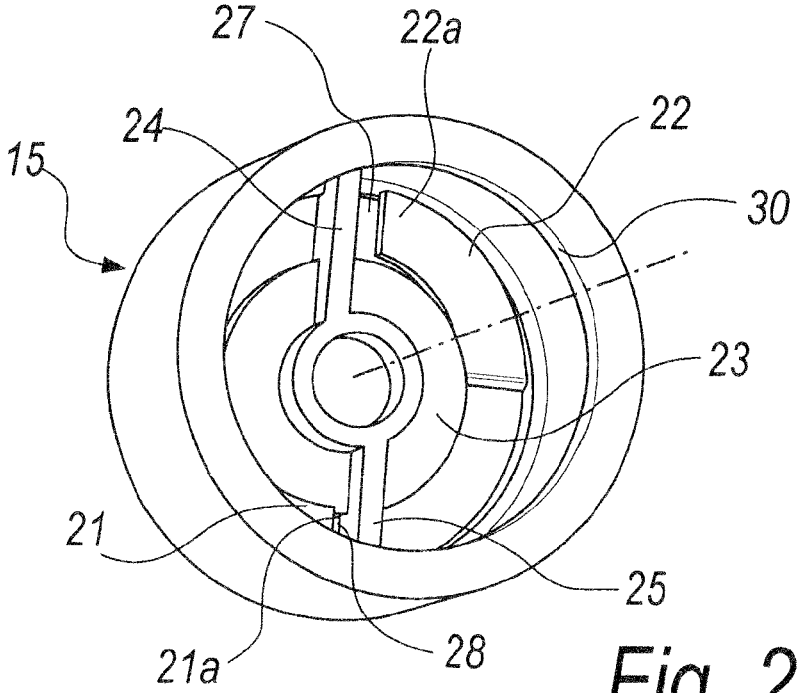
FIG. 2 is a perspective view of a detail of the screw cap according to the invention, in the first variant thereof.

With reference to the cited drawings a screw cap according to the invention is overall shown, in a first embodiment thereof, with the reference number 10.

The screw cap 10 for container for liquids comprises a first capsule 11, internally provided with a thread 12 to be screwed onto a corresponding complementary thread 13 of a neck of a bottle 14.

The cap comprises also a second capsule 15 surrounding the first capsule 11 and arranged to rise axially away from the first capsule 11 at the first unscrewing, by means of spacing means, better described hereinbelow, which act at the first rotation of the second capsule 15 relatively to the first capsule 11.

There are further provided means for the irreversible locking, described in the following, of the second capsule 15 in raised configuration relatively to the first capsule 11.

The rising of the second capsule 15 relatively to the first one 11 clears an annular surface portion 16 of the first capsule 11, the sight of the annular surface portion 16 is adapt to show that the first opening of the cap 10.

The spacing means acting at the first rotation of the second capsule 15 relatively to the first one 11, is provided by two diametrically opposed protrusions 18 and 19 that extend in axial direction from the covering portion 20 of the first capsule 11 toward the second capsule 15; corresponding fins 21, 22 being arranged so as to slide, upon rotation of the second capsule 15, on that protrusions 18, 19, the fins being inclined so as to protrude in a cantilever fashion towards the first capsule 11 from the covering portion 23 of the second capsule 15.

In front of the free end 21*a* and 22*a* of a fin 21 and 22, an abutment wall 24 and 25 is defined, against which the tip of the protrusion 18 and 19 is designed to abut.

Between the free ends 21*a* and 22*a* and the facing corresponding abutment walls 24 and 25 corresponding openings 27 and 28 are defined for the snap engagement therein of the tips 18*a* and 19*a* of the corresponding protrusions 18 and 19.

The openings 27, 28 and the tips 18*a*, 19*a* define the above-mentioned irreversible locking means for the second capsule 15 in raised configuration relative to the first capsule 11.

The annular surface portion 16, which is visible as a consequence of the spacing of the second capsule 15 from the first capsule 11, is delimited at the side of the mouth of the bottle by the lower edge of the first capsule 11 to which it belongs, and at the opposite side by an annular extraction-preventing portion 30 that radially protrudes inward from the edge of the second capsule 15, the annular extraction-preventing portion 30 is designed to abut against a corresponding external shoulder 31 defined in the first capsule 11.

The first capsule 11 is advantageously made monolithically in plastic material.

In addition the second capsule 15 is advantageously monolithically moulded in plastic material.

Both the first 11 and the second capsule 15 can be also made in other materials according to the requirements and needs.

The functioning of the screw cap according to the invention is the following.

When the cap 10 is screwed for the first time on the neck of the bottle 14, the walls 24 and 25 contact respectively the tips 18*a* and 19*a*, at the opposite side in relation to the corresponding fins 21 and 22, therefore the rotation of the second capsule 15 that is external in the screwing direction, causes also the first capsule 11 that is internal to be dragged in rotation. The first capsule 11 is thus screwed on the complementary thread 13 of the neck 14.

Upon the first unscrewing, the first capsule 11 remains fixed screwed to the neck 14, whilst the second capsule 15 rotates in relation to the first capsule 11 until the inclined fins 21 and 22 touch the corresponding protrusions 18 and 19.

Figure 3:
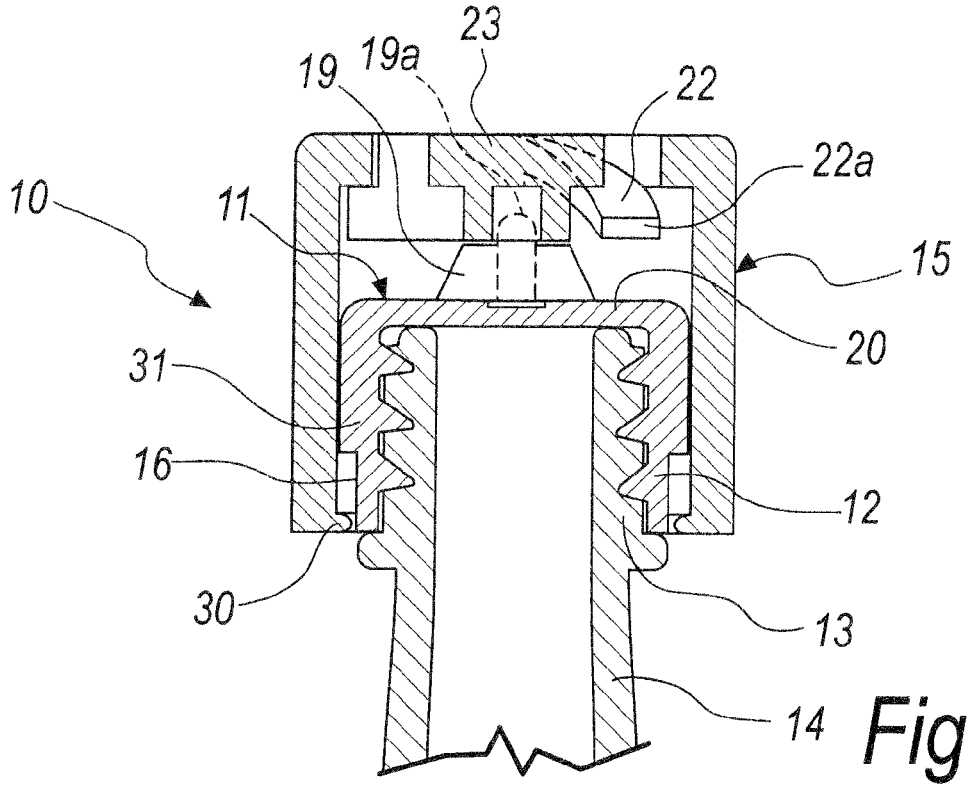
FIG. 3 is a side sectional view of the screw cap according to the invention, in a use configuration.
Figure 4:
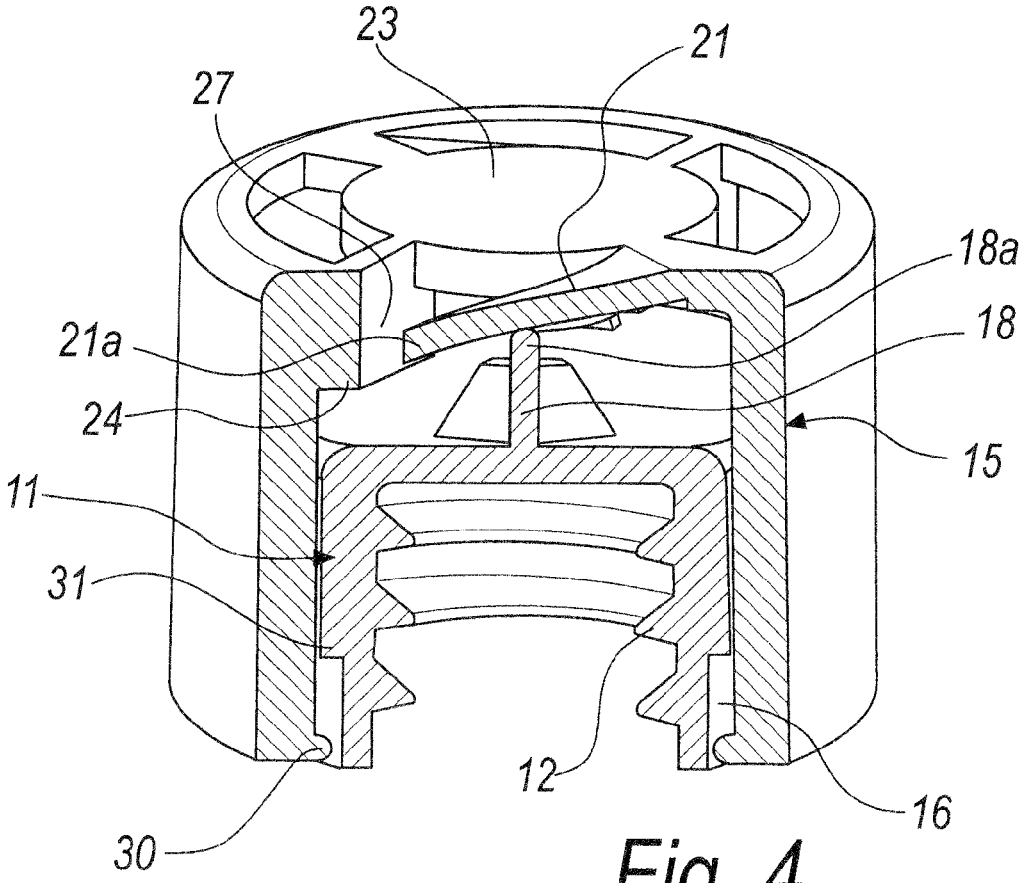
FIG. 4 is a perspective section of the cap according to the invention, in an intermediate temporary use configuration.

The sliding of the inclined fins 21 and 22 on the protrusions 18 and 19 causes at the same time the rotation of the second capsule 15 in relation to the first capsule 11, and also the axial spacing of the second capsule 15 from the first one, as shown in the FIGS. 3 and 4.

Figure 5:
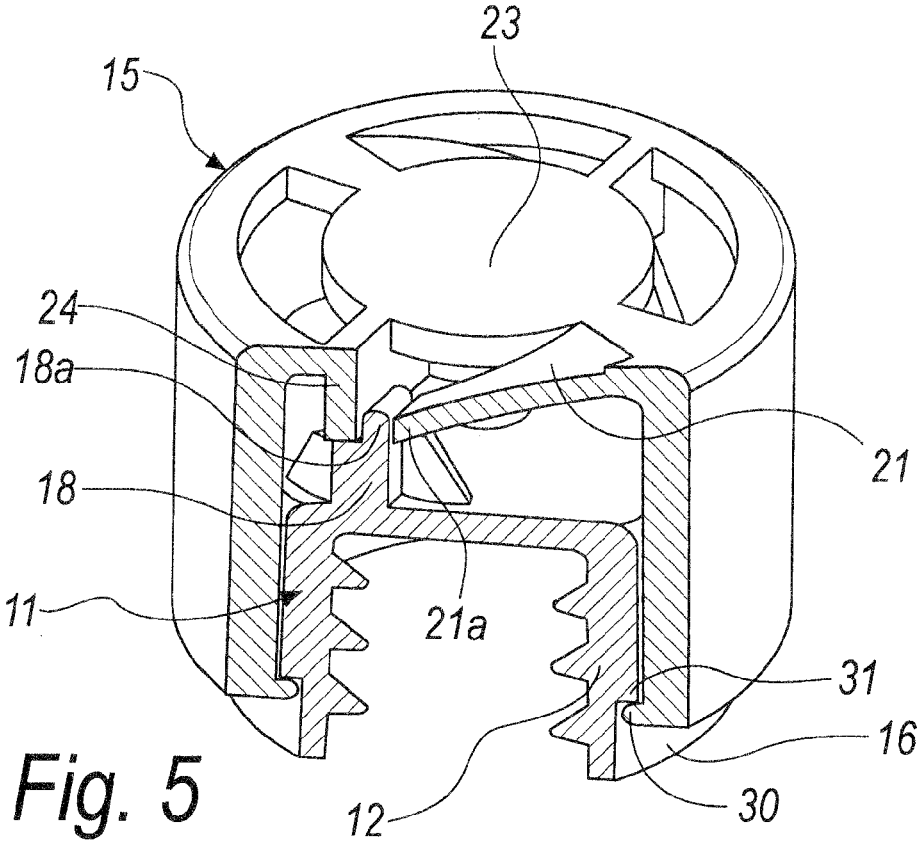
FIG. 5 is a perspective section of the cap according to the invention, in an second use configuration.

By continuing with the rotation (FIG. 5) the tips 18*a* and 19*a* of the protrusions 18 and 19 are snap inserted into the openings 27 and 28, and abut against the walls 24 and 25.

In this configuration of snap engagement, the annular surface portion 16 of the first capsule 11 is visible and shows that the first opening of the bottle 14 is occurred.

On the annular surface portion 16 may be applied signs particularly showing that the first opening has occurred, or the annular surface portion 16 may be made in a colour defining an evident chromatic difference with the colour of the above second capsule 15 or of a possible jacket capsule, not shown for sake of simplicity, which would be positioned to coat the second capsule 15.

In this snap engagement configuration, the two capsule 11 and 15 are integral one with another and the prosecution of the unscrewing of the second capsule 15 causes also the unscrewing of the first capsule 11 in relation to the complementary thread 13 of the bottle 14.

Figure 6:
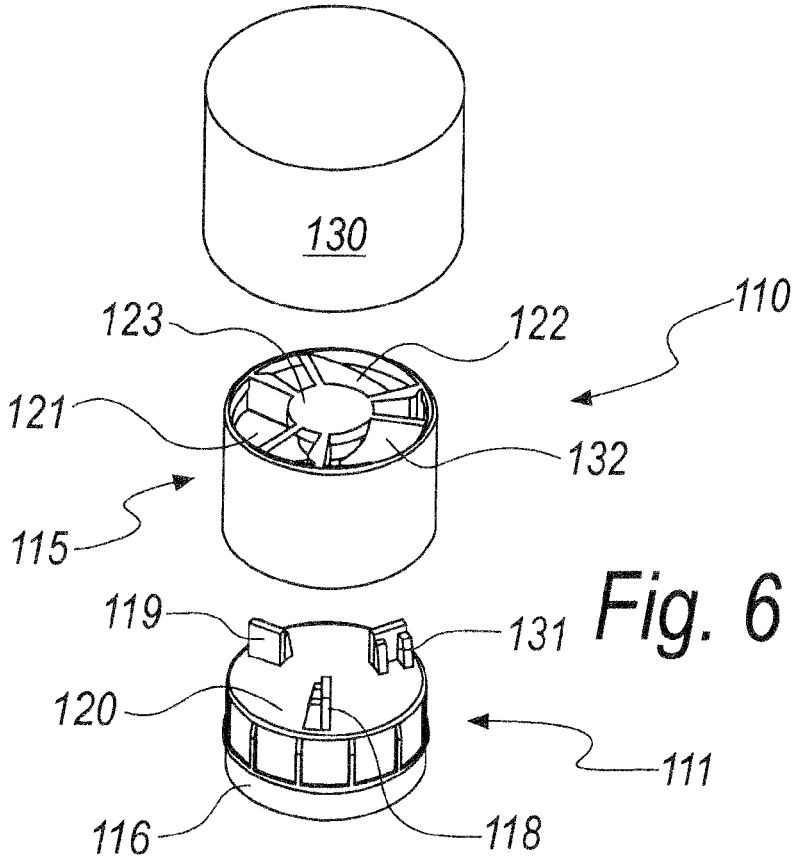
FIG. 6 is an exploded perspective view of a screw cap according to the invention, in a second variant thereof.

In FIG. 6 it is depicted a second embodiment of the screw cap according to the invention that is overall indicated with the reference number 110. In this second embodiment, that is exemplifying and not limitative too, the screw cap 110 comprises a first capsule 111 and a second capsule 115 arranged to surround the first capsule 111 and to rise in axial direction away from the first capsule 111 at the first unscrewing, by spacing means acting at the first rotation of the second capsule 115 in relation to the first capsule 111.

With the numeral 130 it is indicated a covering hood of the second capsule 115, on which may be applied identifying, distinctive or ornamental signs according to the needs, requirements, and tastes of the user.

The covering hood 130 may be made in aluminium, or in plastic material, or in another material according to the needs.

The covering hood 130 is associatable with the second capsule 115 by seaming, or by adhesive bonding or by folding the lower edge onto the corresponding edge of the second capsule 115, or by means of similar and equivalent systems.

The rising of the second capsule 115 in relation to the first one 111 clears an annular surface portion 116 of the first capsule 111, the sight of which is suitable for signalling that the first opening of the cap 110 has occurred.

The spacing means, acting at the first rotation of the second capsule 115 in relation to the first capsule 111, are provided by three equidistant protrusions 118, 119, 131, which extend in axial direction from the covering portion 120 of the first capsule 111 towards the second capsule 115; three corresponding fins 121, 122, 132, being arranged so as to slide, upon rotation of the second capsule 115, on the protrusions 118, 119, 131, the fins 121, 122, 132, being inclined so as to protrude in a cantilever fashion towards the first capsule 111 from the covering portion 124 of the same second capsule 115.

The functioning of the second embodiment of the screw cap 110 according to the invention is the same as that described above for the first embodiment.

It has been ascertained that the invention fulfils the aim and the proposed objects.

By means of the invention it has been provided a screw cap that undoubtedly shows that the opening has occurred, and without the risks that have the known screw caps with safety ring, since the cap according to the invention it is void of any safety ring.

Furthermore with the present invention it has been provided a screw cap that is easy to manage with the known cap-moving and bottling machines.

In addition with the present invention it has been provided a screw cap having a visual impact not lower that that of the known screw caps.

Furthermore with the present invention it has been provided a screw cap that after the first opening does not cause annoying movements if a safety ring on the neck of the corresponding bottle, since, as seen above, no detachable safety ring is provided.

Furthermore with the present invention it has been provided a screw cap having technical performances not lower than those of known caps.

In addition with the present invention it has been provided a screw cap that is easy to manufacture and easy to be used, that can be produced with known techniques and with limited expenses.

The conceived invention is susceptible of many modifications and versions, all forming part of the same inventive concept; furthermore all the details can be substituted with other technically equivalent elements.

The material used and also the dimensions and the contingent shapes can be any according to the needs and the state of the art.

Where the features and the techniques mentioned in any claims are followed by reference numeral, such numerals are apposed only by reference without any limiting effect.

The invention claimed is:

1. A screw cap for containers for liquids, comprising a first capsule, which is internally provided with a thread and is to be screwed onto a corresponding complementary thread of a neck of a bottle, and a second capsule, which surrounds said first capsule and is designed to rise axially away from the first capsule upon first unscrewing, by means of spacing means that act at a first rotation of the second capsule with respect to the first capsule, wherein means are provided for an irreversible locking of said second capsule in a raised configuration relative to said first capsule, the irreversible locking means being configured for rotatably fixing said first and second capsules one in relation to the other in said raised configuration, upon first unscrewing.

2. The cap according to claim 1, wherein the irreversible locking means comprise rotation blocking means and axial blocking means between said first and second capsules the rotation blocking means and the axial blocking means being independent from one another.

3. The cap according to claim 1, wherein said second capsule is configured to rise relative to said first capsule clearing an annular surface portion of said first capsule, the sight of which is adapted to show that the first opening of the cap has occurred.

4. The cap according to claim 3, wherein said annular surface portion, which is visible as a consequence of the spacing of the second capsule from the first capsule, is delimited at a region of the mouth of the bottle by a lower edge of the first capsule to which it belongs, and at an opposite region by an annular extraction-preventing portion, which protrudes radially inward from a lower edge of the second capsule, said extraction-preventing annular portion being configured to abut against a corresponding external shoulder formed on said first capsule.

5. The cap according to claim 1, wherein said spacing means, which act upon the first rotation of the second capsule with respect to the first capsule, are provided by protrusions that extend axially from a covering portion of the first capsule toward the second capsule, corresponding fins being arranged so as to slide, upon rotation of the second capsule, on said protrusions, said fins being inclined so as to protrude in a cantilever fashion towards the first capsule from a covering portion of said second capsule.

6. The cap according to claim 5, wherein facing a free end of at least one of said fins there is a corresponding abutment wall, against which a tip of a protrusion is configured to abut, wherein between said free ends of said fins and the corresponding abutment walls there are corresponding openings for snap engagement therein of the tips of the respective protrusions, said openings and said tips forming said irreversible locking means of the second capsule in the raised configuration relative to said first capsule.

7. The cap according to claim 1, wherein said first capsule comprises plastic material.

8. The cap according to claim 1, wherein said second capsule comprises plastic material.

9. The cap according to claim 1, wherein a covering hood is associatable with said second capsule.

10. The cap according to claim 9, wherein said covering hood comprises at least one material selected from the group consisting of aluminium and plastic material.

11. The cap according to claim 9, wherein said covering hood is associatable with the second capsule by seaming.

12. The cap according to claim 9, wherein said covering hood is associatable with the second capsule by adhesive bonding.

13. The cap according to claim 9, wherein said covering hood is associatable with the second capsule by folding a lower edge onto a corresponding edge of the second capsule.

14. The cap according to claim 9, wherein at least one of identification, distinctive and ornamental markings are applied to said covering hood.

15. The cap according to claim 1, wherein said first capsule is monolithically plastic material.

16. The cap according to claim 1, wherein said second capsule is monolithically moulded in plastic material.

* * * * *